US005727405A

United States Patent [19]

Cromwell

[11] Patent Number: 5,727,405

[45] Date of Patent: Mar. 17, 1998

[54] ALARM PADLOCK

[76] Inventor: Daryl Cromwell, 825 Willow Creek Way, Troy, Ohio 45373

[21] Appl. No.: 794,180

[22] Filed: Feb. 3, 1997

[51] Int. Cl.[6] ..... E05B 45/08

[52] U.S. Cl. ..... 70/38 B; 70/52; 70/53; 70/439; 70/DIG. 49; 340/427; 340/542

[58] Field of Search ..... 70/18, 30, 49, 70/25, 51, 52, 38 R, 38 A, 38 B, 38 C, 39, 53, 435, 439, DIG. 49, 233; 340/427, 432, 542, 543

[56] References Cited

U.S. PATENT DOCUMENTS

| | | | |
|---|---|---|---|
| 597,891 | 1/1898 | Walstrom et al. | 70/234 |
| 3,824,540 | 7/1974 | Smith, II | 340/427 |
| 3,879,721 | 4/1975 | Yereance | 340/427 X |
| 3,993,987 | 11/1976 | Stevens | 340/542 |
| 4,546,345 | 10/1985 | Naito | 70/DIG. 49 X |
| 4,556,872 | 12/1985 | Masoncup et al. | 340/542 |
| 4,811,578 | 3/1989 | Masoncup et al. | 70/38 B |
| 5,404,735 | 4/1995 | Hsieh | 70/38 A |
| 5,587,702 | 12/1996 | Chadfield | 340/542 |
| 5,598,725 | 2/1997 | Chang | 70/DIG. 49 X |

*Primary Examiner*—Lloyd A. Gall
*Attorney, Agent, or Firm*—Michael I. Kroll

[57] ABSTRACT

An alarm padlock (10) comprising a shackle (12) having a long leg (14) and a short leg (16). A body (18) is provided. A facility (20) in the body (18) is for mounting the shackle (12) in a reciprocal movement between a closed position and an extended open position, in which the short leg (16) of the shackle (12) is outside of the body (18) and the long leg (14) of the shackle (12) can swivel within the body (18). A latch mechanism (22) in the body (18) engages with the short leg (16) of the shackle (12), when the shackle (12) is in it's closed position. A lock mechanism (24) in the body (18) is operable to disengage the latch mechanism (22) from the short leg (16) of the shackle (12). An alarm circuit (26) in the body (18) actuates to emit a warning signal when an unauthorized person violates and tampers with the shackle (12) and the body (18).

17 Claims, 4 Drawing Sheets

ALARM PADLOCK

BACKGROUND OF THE INVENTION

1. Field of the Invention

The instant invention relates generally to antitheft padlocks and more specifically it relates to an alarm padlock. The alarm padlock will activate when someone violates or tampers with it.

2. Description of the Prior Art

Numerous antitheft padlocks have been provided in prior art. For example, U.S. Pat. Nos. 4,556,872 to Masoncup et al.; 4,811,578 to Masoncup et al. and 5,404,735 to Hsieh all are illustrative of such prior art. While these units may be suitable for the particular purpose to which they address, they would not be as suitable for the purposes of the present invention as heretofore described.

MASONCUP, JOHN F.

PETERSON, ERIC O.

PETERSON, ALAN G.

PADLOCK WITH TAMPER ALARM

U.S. Pat. No. 4,556,872

A padlock contains a battery connected by electrical circuitry and switches to an alarm sounding device which sounds an alarm when someone attempts to force open or sever the lock shackle or when someone attempts to remove the battery in an unauthorized manner. A test signal of momentary duration is automatically sounded each time the lock is opened or closed in an authorized manner, and this indicates whether the alarm system is operative.

MASONCUP, JOHN F.

MAYER, THOMAS J.

PADLOCK WITH TAMPER-ACTIVATED AUDIBLE AND/OR INAUDIBLE ALARM

U.S. Pat. No. 4,811,578

A padlock comprises a battery-powered, built-in alarm which operates when the padlock's shackle is severed or forced open. The battery and alarm can be tested by opening the lock with a key, rotating the short leg of the shackle away from the lock body and then depressing the shackle, or optionally, by depressing the short leg. The alarm is turned on in response to the momentary closing of a switch when one shackle leg moves outwardly upon severance or forcible opening. The alarm may be an audible signal or an inaudible signal transmitted as a radio wave to a remote receiver at which an audible or visible signal is actuated. The audible signal generated at the lock escapes from the lock body through sound ports. Both audible and inaudible signals may be generated at the lock simultaneously.

HSIEH, CHEN-KUEI

PADLOCK WITH BUILT-IN ANTI-THEFT ALARM DEVICE

U.S. Pat. No. 5,404,735

A padlock with a built-in anti-theft alarm device that is comprised of a padlock mechanism consisting of a lock structure having a rotational locking pintle bar that is revolved a certain angle to achieve locking and unlocking, a cam suitably positioned at the center of the pintle bar, an electric switch that is actuated by the cam pushing against a switching device, an alarm circuit with an independent power supply and a vibration sensor device. The rotation of the pintle bar revolves the cam such that the lobe pushes against and closes the electric switch, which initiates the operation of the alarm circuit. The vibration sensor device triggers the alarm circuit to emit an alarm sound whenever abnormal vibration is detected. The alarm circuit has an independent power supply that is securely protected by the outer padlock case to prevent damage and power loss. The key head of the padlock mechanism has a two-position rotating lock setting that can be selectively locked or unlocked with or without setting the alarm circuit for operation to prevent the unwanted sounding of the alarm.

SUMMARY OF THE INVENTION

A primary object of the present invention is to provide an alarm padlock that will overcome the shortcomings of the prior art devices.

Another object is to provide an alarm padlock that will activate an alarm circuit when an unauthorized person violates or tampers with the body or shackle of the padlock.

An additional object is to provide an alarm padlock that contains a trip wire built into the shackle, so that if the shackle is cut, the alarm circuit will be set off.

A further object is to provide an alarm padlock that is simple and easy to use.

A still further object is to provide an alarm padlock that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
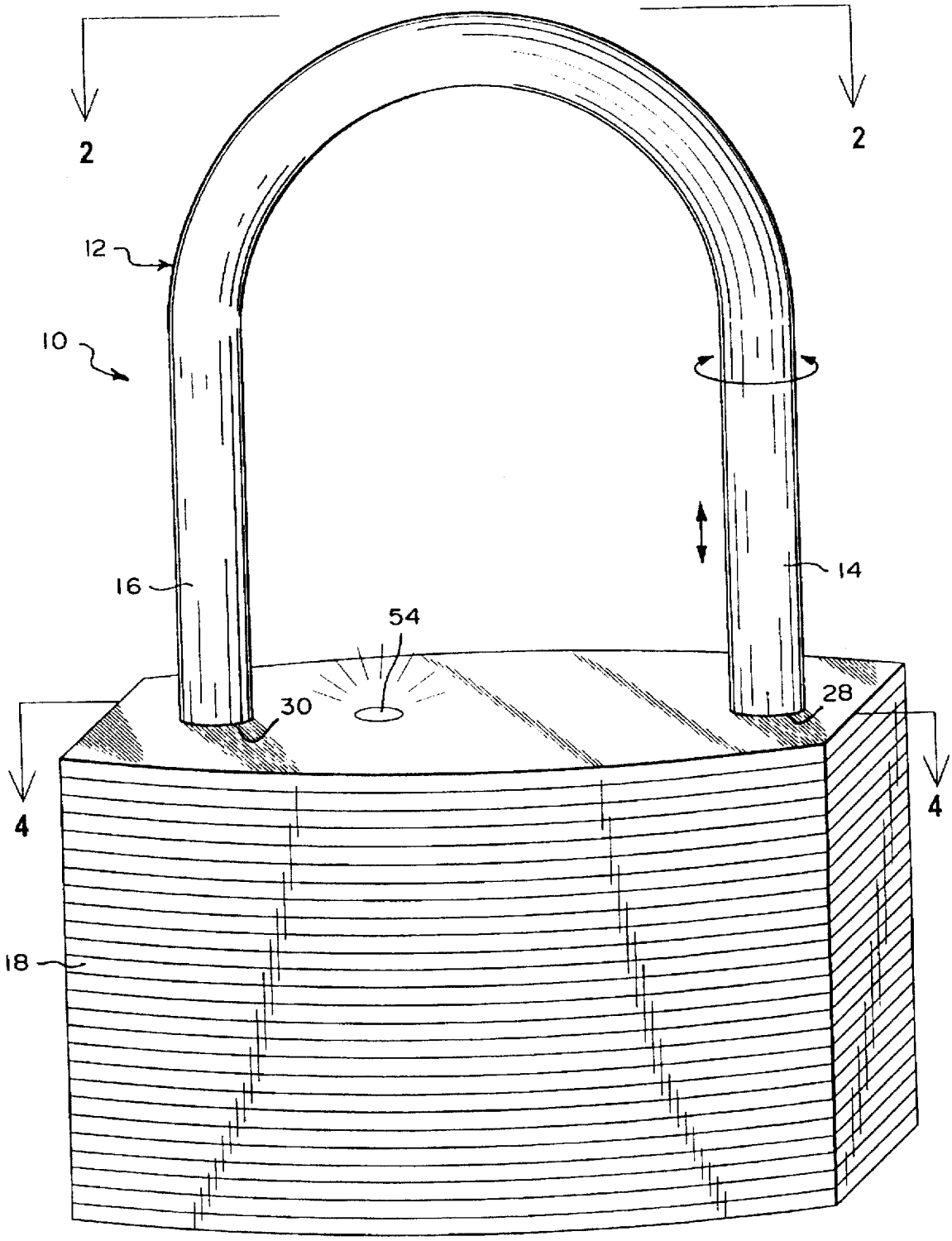
FIG. 1 is a perspective view of the instant invention.
Figure 2:
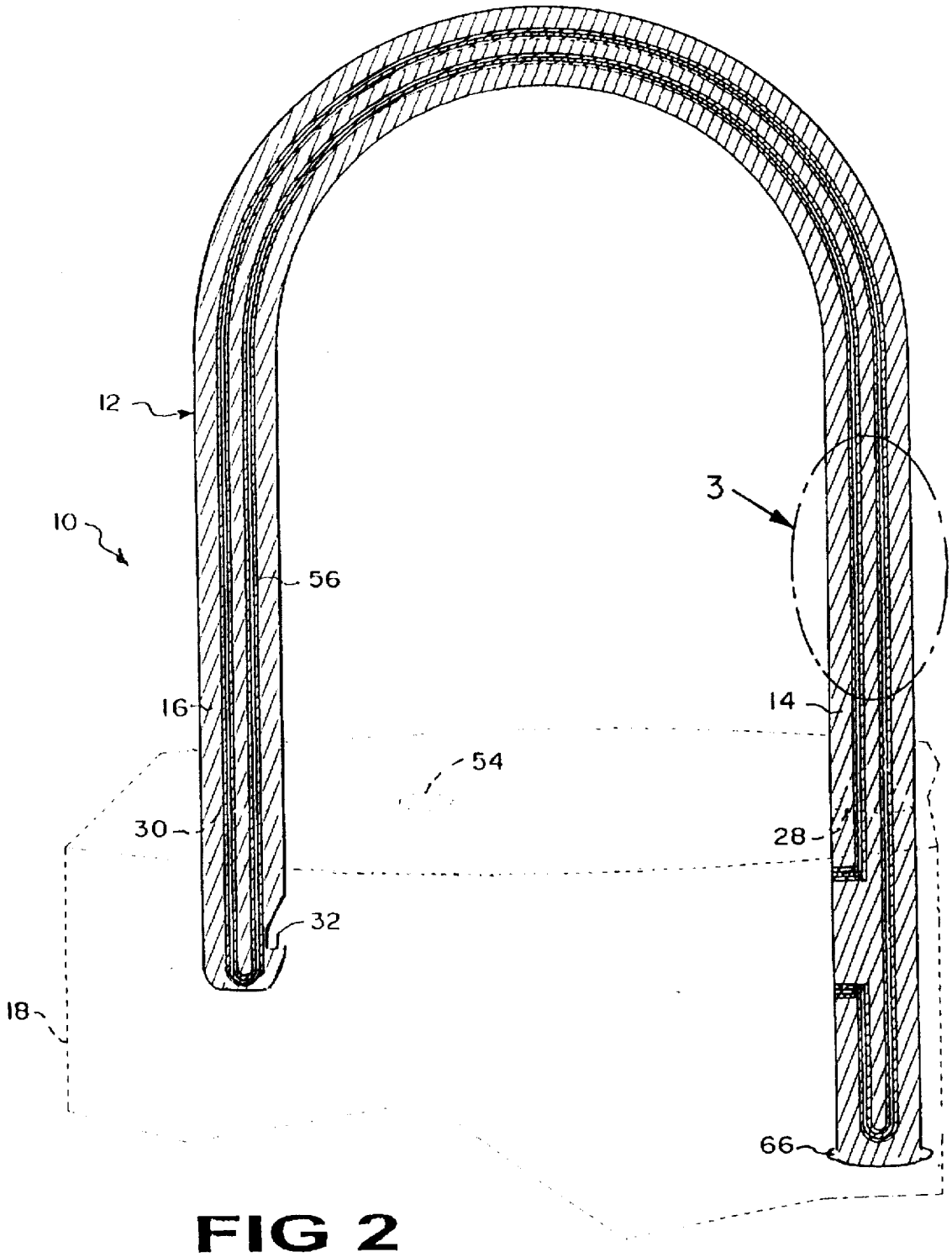
FIG. 2 is a cross sectional view taken along line 2—2 in FIG. 1, showing the trip wire extending through the shackle.
Figure 3:
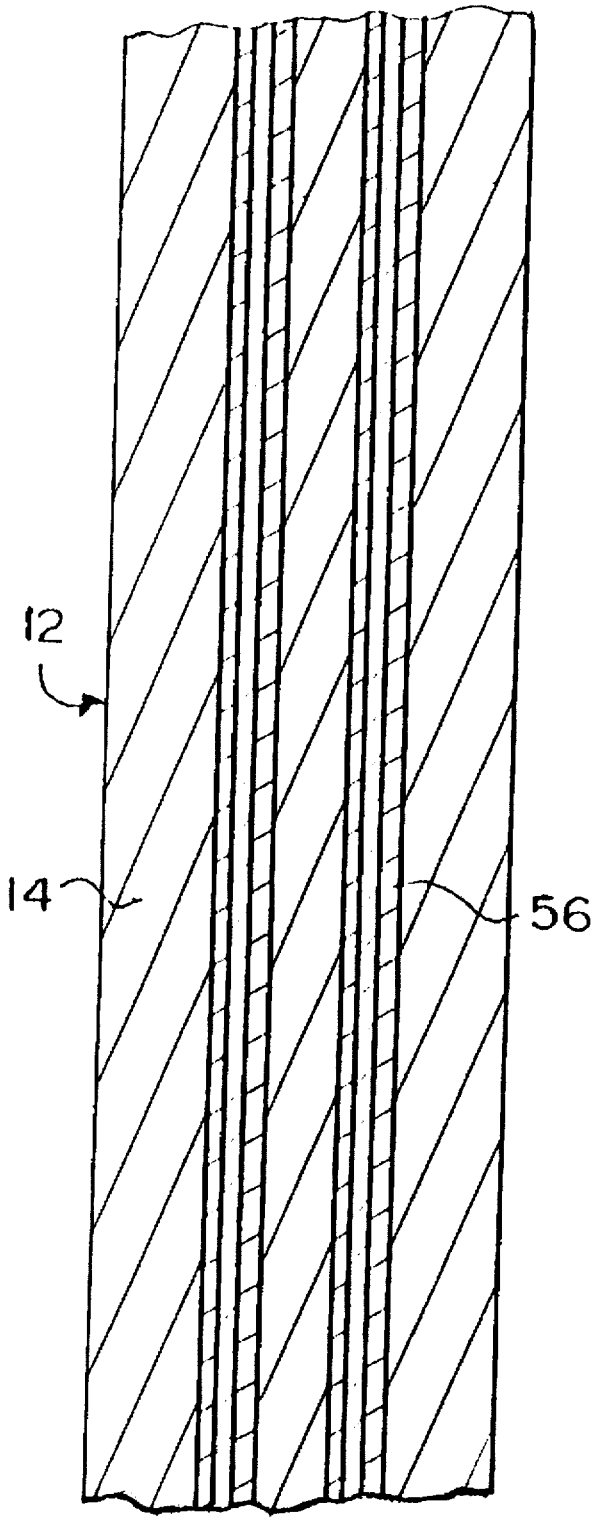
FIG. 3 is an enlarged cross sectional view of the area in FIG. 2, as indicated by arrow 3.

Turning now descriptively to the drawings, in which similar reference characters denote similar elements throughout the several views. FIGS. 1 through 4 illustrate an alarm padlock 10 comprising a shackle 12 having a long leg 14 and a short leg 16. A body 18 is provided. A facility 20 in the body 18 is for mounting the shackle 12 in a reciprocal movement between a closed position and an extended open position, in which the short leg 16 of the shackle 12 is outside of the body 18 and the long leg 14 of the shackle 12 can swivel within the body 18.

A latch mechanism 22 in the body 18 engages with the short leg 16 of the shackle 12, when the shackle 12 is in it's closed position. A lock mechanism 24 in the body 18 is operable to disengage the latch mechanism 22 from the short leg 16 of the shackle 12. An alarm circuit 26 in the body 18 actuates to emit a warning signal when an unauthorized person violates and tampers with the shackle 12 and the body 18.

The mounting facility 20 consists of the body 18 having a first channel 28 therein, to receive the long leg 14 of the shackle 12. The body 18 also has a second channel 30 therein, to receive the short leg 16 of the shackle 12.

The latch mechanism 22 includes the short leg 16 of the shackle 12 having a side notch 32 therein. A latch bar 34 is carried within the body 18. A coil spring 36 in the body 18 urges the latch bar 34 towards the short leg 16 of the shackle 12, so that an end of the latch bar 34 will engage with the side notch 32 on the short leg 16 of the shackle 12, when the shackle 12 is in it's closed position.

Figure 4:
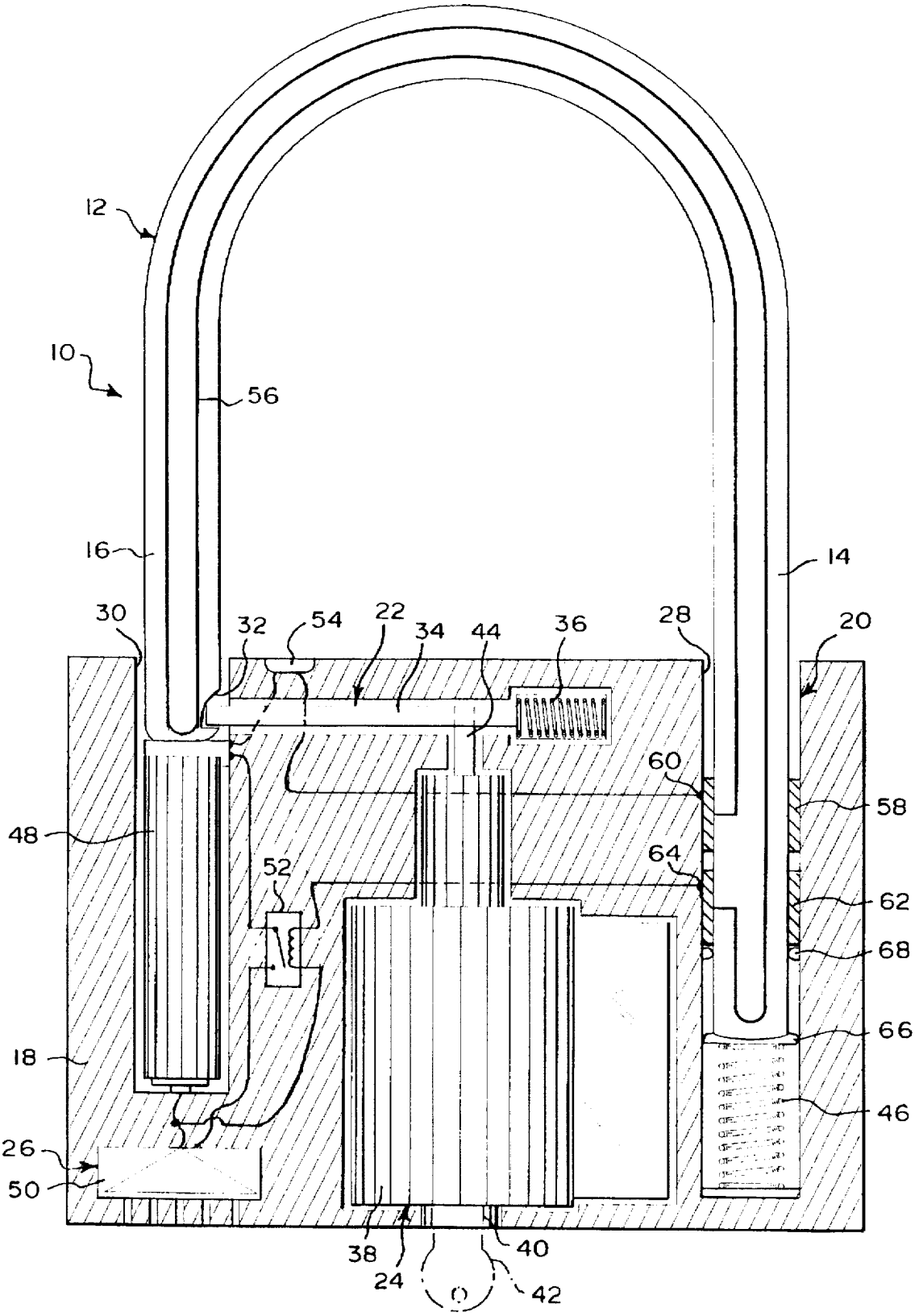
FIG. 4 is a cross sectional view taken along line 4—4 in FIG. 1, showing the internal construction within the body of the padlock.

The lock mechanism 24 comprises a cylinder 38 having an outer end 40 with a key slot to receive a key 42, shown in phantom in FIG. 4, to operate the cylinder 38. An arm 44 extends from the cylinder 38, to engage with and operate the latch mechanism 22. An expansion spring 46 is in a bottom end of the first channel 28 to normally urge the long leg 14 upwardly, so that the shackle 12 will go into the extended open position.

The alarm circuit 26 contains a battery 48. An audible alarm 50 is also provided. A normally opened relay 52 is electrically connected between the battery 48 and the audible alarm 50. If the alarm circuit 26 is broken to the normally opened relay 52, the normally opened relay 52 will close to connect the battery 48 to the audible alarm 50 and operate the audible alarm 50.

The alarm circuit 26 further includes a light-emitting diode 54 electrically connected between the battery 48 and the normally opened relay 52, as to visually indicate that the alarm circuit 26 is in it's operating mode. An insulated loop trip wire 56 within the shackle 12 extends between the long leg 14 and the short leg 16. If the insulated loop trip wire 56 in the alarm circuit 26 is broken, the audible alarm 50 will emit the warning signal.

The alarm circuit 26 further includes a first insulated contact ring 58 about the long leg 14 of the shackle 12 and is electrically connected to a first end of the insulated loop trip wire 56. A first contact member 60 is in the first channel 28 of the body 18, to electrically connect with the first insulated contact ring 58. A second insulated contact ring 62 is also about the long leg 14 of the shackle 12 and is electrically connected to a second end of the insulated loop trip wire 56. A second contact member 64 is in the first channel 28 of the body 18, to electrically connect with the second insulated contact ring 62. The long leg 14 of the shackle 12 can swivel within the first channel 28 of the body 18 and allow the insulated loop trip wire 56 to maintain electrical contact with the alarm circuit 26.

The alarm padlock 10 further contains a flange 66 on a bottom end of the long leg 14 of the shackle 12. A stop structure 68 is in the first channel 28 of the body 18 above the flange 66. The flange 66 will engage with the stop structure 68, when the expansion coil 46 urges the long leg 14 upwardly and the shackle 12 goes into the extended open position.

LIST OF REFERENCE NUMBERS

10 alarm padlock
12 shackle of 10
14 long leg of 12
16 short leg of 12
18 body of 10
20 mounting facility in 18 for 12
22 latch mechanism of 10
24 lock mechanism of 10
26 alarm circuit of 10
28 first channel of 20 in 18 for 14
30 second channel of 20 in 18 for 16
32 side notch in 16
34 latch bar of 22
36 coil spring of 22
38 cylinder of 24
40 outer end of 38
42 key of 24
44 arm of 24
46 expansion spring in 28
48 battery of 26
50 audible alarm of 26
52 normally opened relay of 26
54 light-emitting diode of 26
56 insulated loop trip wire of 26
58 first insulated contact ring of 26
60 first contact member of 26
62 second insulated contact ring of 26
64 second contact member of 26
66 flange on 14
68 stop structure in 28

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An alarm padlock comprising:

a) a shackle having a long leg and a short leg;

b) a body;

c) means in said body for mounting said shackle in a reciprocal movement between a closed position and an extended open position, in which said short leg of said shackle is outside of said body and said long leg of said shackle can swivel within said body;

d) a latch mechanism in said body to engage with said short leg of said shackle, when said shackle is in it's closed position;

e) a lock mechanism in said body operable to disengage said latch mechanism from said short leg of said shackle;

f) an alarm circuit in said body actuates to emit a warning signal when an unauthorized person violates and tampers with said shackle and said body; said alarm circuit further includes an insulated loop trip wire within said shackle extending between said long leg and said short leg, so that if said insulated loop trip wire in said alarm circuit is broken, said audible alarm will emit the warning signal; a first insulated contact ring about said long leg of said shackle and electrically connected to a first end of said insulated loop trip wire; and a first contact member in a first channel of said body to electrically connect with said first insulated contact ring.

2. An alarm padlock as recited in claim 1, wherein said mounting means includes:

a) said body having said first channel therein to receive said long leg of said shackle; and b) said body having a second channel therein to receive said short leg of said shackle.

3. An alarm padlock as recited in claim 2, further including an expansion spring in a bottom end of said first channel to normally urge said long leg upwardly, so that said shackle will go into the extended open position.

4. An alarm padlock as recited in claim 2, wherein said alarm circuit includes:

a) a battery;

b) an audible alarm; and c) a normally opened relay electrically connected between said battery and said audible alarm, so that if said alarm circuit is broken to said normally opened relay, said normally opened relay will close to connect said battery to said audible alarm and operate said audible alarm.

5. An alarm padlock as recited in claim 4, wherein said alarm circuit further includes a light-emitting diode electrically connected between said battery and said normally opened relay, as to visually indicate that said alarm circuit is in it's operating mode.

6. An alarm padlock as recited in claim 3, further including:

a) a flange on a bottom end of said long leg of said shackle; and b) a stop structure in said first channel of said body above said flange, so that said flange will engage with said stop structure, when said expansion spring urges said long leg upwardly and said shackle goes into the extended open position.

7. An alarm padlock as recited in claim 1, wherein said latch mechanism includes:

a) said short leg of said shackle having a side notch therein;

b) a latch bar carried within said body; and c) a coil spring in said body to urge said latch bar towards said short leg of said shackle, so that an end of said latch bar will engage with said side notch on said short leg of said shackle, when said shackle is in it's closed position.

8. An alarm padlock as recited in claim 1, wherein said lock mechanism includes:

a) a cylinder having an outer end with a key slot to receive a key, to operate said cylinder; and b) an arm extending from said cylinder to engage with and operate said latch mechanism.

9. An alarm padlock as recited in claim 1, wherein said alarm circuit further includes:

a) a second insulated contact ring about said long leg of said shackle and electrically connected to a second end of said insulated loop trip wire; and b) a second contact member in said first channel of said body to electrically connect with said second insulated contact ring, so that said long leg of said shackle can swivel within said first channel of said body and allow said insulated loop trip wire to maintain electrical contact with said alarm circuit.

10. An alarm padlock comprising:

a) a shackle having a long leg and a short leg;

b) a body;

c) means in said body for mounting said shackle in a reciprocal movement between a closed position and an extended open position, in which said short leg of said shackle is outside of said body and said long leg of said shackle can swivel within said body, wherein said mounting means includes said body having a first channel therein to receive said long leg of said shackle and said body having a second channel therein to receive said short leg of said shackle;

d) a latch mechanism in said body to engage with said short leg of said shackle, when said shackle is in it's closed position;

e) a lock mechanism in said body operable to disengage said latch mechanism from said short leg of said shackle;

f) an alarm circuit in said body actuates to emit a warning signal when an unauthorized person violates and tampers with said shackle and said body; said alarm circuit further includes an insulated loop trip wire within said shackle extending between said long leg and said short leg, so that if said insulated loop trip wire in said alarm circuit is broken, said audible alarm will emit the warning signal; a first insulated contact ring about said long leg of said shackle and electrically connected to a first end of said insulated loop trip wire; and a first contact member in said first channel of said body to electrically connect with said first insulated contact ring.

11. An alarm padlock as recited in claim 10, wherein said latch mechanism includes:

a) said short leg of said shackle having a side notch therein;

b) a latch bar carried within said body; and c) a coil spring in said body to urge said latch bar towards said short leg of said shackle, so that an end of said latch bar will engage with said side notch on said short leg of said shackle, when said shackle is in it's closed position.

12. An alarm padlock as recited in claim 11, wherein said lock mechanism includes:

a) a cylinder having an outer end with a key slot to receive a key, to operate said cylinder; and b) an arm extending from said cylinder to engage with and operate said latch mechanism.

13. An alarm padlock as recited in claim 12, further including an expansion spring in a bottom end of said first channel to normally urge said long leg upwardly, so that said shackle will go into the extended open position.

14. An alarm padlock as recited in claim 13, wherein said alarm circuit includes:

a) a battery;

b) an audible alarm; and c) a normally opened relay electrically connected between said battery and said audible alarm, so that if said alarm circuit is broken to said normally opened relay, said normally opened relay will close to connect said battery to said audible alarm and operate said audible alarm.

15. An alarm padlock as recited in claim 14, wherein said alarm circuit further includes a light-emitting diode electrically connected between said battery and said normally opened relay, as to visually indicate that said alarm circuit is in it's operating mode.

16. An alarm padlock as recited in claim 10, wherein said alarm circuit further includes:

a) a second insulated contact ring about said long leg of said shackle and electrically connected to a second end of said insulated loop trip wire; and b) a second contact member in said first channel of said body to electrically connect with said second insulated contact ring, so that said long leg of said shackle can swivel within said first channel of said body and allow said insulated loop trip wire to maintain electrical contact with said alarm circuit.

17. An alarm padlock as recited in claim 16, further including:

a) a flange on a bottom end of said long leg of said shackle; and b) a stop structure in said first channel of said body above said flange, so that said flange will engage with said stop structure, when said expansion spring urges said long leg upwardly and said shackle goes into the extended open position.

* * * * *